US005160009A

United States Patent [19]

Iyoda et al.

[11] Patent Number: 5,160,009

[45] Date of Patent: Nov. 3, 1992

[54] PASSENGER CONVEYOR AND MOVING HANDRAIL FOR PASSENGER CONVEYOR AND MANUFACTURING METHOD THEREFOR

[75] Inventors: Hiroumi Iyoda; Chuichi Saito, both of Katsuta; Mamoru Shiina; Yoshitaka Fujii, both of Hitachi, Japan

[73] Assignees: Hitachi, Ltd.; Hitachi Cable, Ltd., both of Tokyo, Japan

[21] Appl. No.: 519,121

[22] Filed: May 4, 1990

[30] Foreign Application Priority Data

May 8, 1989 [JP] Japan ..... 1-113745
Sep. 20, 1989 [JP] Japan ..... 1-242261

[51] Int. Cl.[5] ..... B66B 23/24
[52] U.S. Cl. ..... 198/337; 198/335
[58] Field of Search ..... 198/330, 331, 335, 337, 198/338

[56] References Cited

U.S. PATENT DOCUMENTS 2,885,057 5/1959 Hansen ..... 198/331 X
2,919,786 1/1960 Tilton ..... 198/337
3,442,367 5/1969 Van Voorhis ..... 198/335
3,865,225 2/1975 Phal ..... 198/337
4,598,811 7/1986 Hanano et al. ..... 198/335

FOREIGN PATENT DOCUMENTS 48-87786 10/1973 Japan .
57-169768 10/1982 Japan .

*Primary Examiner*—Joseph E. Valenza
*Assistant Examiner*—Tuan N. Nguyen
*Attorney, Agent, or Firm*—Antonelli, Terry, Stout & Kraus

[57] ABSTRACT

A passenger conveyor comprises a moving handrail mounted on a guide rail provided around a balustrade and a handrail driving device for driving the moving handrail to move circulatively. The moving handrail is constituted by a core member and a surface decorative member which is removably attached, i.e. removably engaged, to the core member, and the core member is driven by the handrail driving device. The moving handrail may be constituted by a core member and a surface decorative member which are formed separately and joined together.

15 Claims, 6 Drawing Sheets

PASSENGER CONVEYOR AND MOVING HANDRAIL FOR PASSENGER CONVEYOR AND MANUFACTURING METHOD THEREFOR

BACKGROUND OF THE INVENTION

1. Field of the Invention

The present invention relates to a passenger conveyor such as an escalator or a motor driver passenger walkway, a moving handrail for the passenger conveyor and a method of manufacturing the same.

2. Prior Art

Passenger conveyors such as an escalator, unavoidably are contaminated due to contact of hands of the passengers with the handrails and contact of the handrails with handrail driving means. To cope with this problem, Japanese Utility Model Unexamined Publication No. 48-87786, proposes sticking a tape to the surface of a moving handrail over the entire length thereof with the tape being removable and exchanged for a new tape at suitable time intervals.

The above conventional technique, however, is not applicable in practice as yet to passenger conveyors of the type in which the moving handrail is driven by being pinched by a plurality of rollers, since it is necessary to frequently exchange the tape due to the fact that the contamination is pressed and stuck on the tape by the pinching pressure of the rollers.

In a conventional chain driver moving handrail 4 such as shown in FIG. 17 and disclosed in Japanese Utility Model Unexamined Publication No. 57-169768 a rubber surface hand contact decorative member 8 is disposed over a core material 7 including a core cord on which the longitudinal tension is applied, laminated sailcloth 6 being horseshoe shaped and interposed between the decorative member 8 and the core material. In manufacturing a moving handrail 4, the core material 7 of the core cord is first placed on the laminated sailcloth 6 which is beforehand laminated and formed into the horseshoe shape, and the rubber surface decorative member 8 is then put on the top layer of the laminated sailcloth 6, and the entire assembly is subsequently pressed for the preliminary forming and is finally subjected to the press vulcanization, thereby manufacturing the moving handrail 4. The handrail 4 is moved in engagement with a guide rail 33 and driven in general by being wound on a pulley (not shown) or by being pinched by rollers (not shown).

Since the conventional handrail of the above structure is obtained after subjecting the rubber surface decorative member 8, the core material 7 of the core cord and the sailcloth 6 to the forming and the press vulcanization, a considerably long time period is required for the manufacturing thereof.

The moving handrail 4 is an endless belt member driven by the rotary frictional force of the driving rollers provided in the lower portion of the balustrade while being guided in a sliding contact manner by the guide rail provided around the outer periphery of the balustrade. Therefore, the moving handrail 4 repeatedly receives mechanical stress while it is being driven such as tensile stress, folding stress, forward bending stress, backward bending stress and friction stress, resulting in the problem of high travelling resistance. Further, the moving handrail is subject to contamination not only from the hands of the passengers but also by contact with the driving rollers.

SUMMARY OF THE INVENTION

An object of the present invention is to provide a passenger conveyor in which the surface of a moving handrail is not susceptible to be contaminated.

Another object of the present invention is to provide a passenger conveyor in which a moving handrail can be used again by changing the color and pattern of the surface thereof as desired.

Still another object of the present invention is to provide a moving handrail for a passenger conveyor of the type which is capable of reducing the time required for the forming of a horseshoe portion and decreasing the overall flexural rigidity due to its removable structure.

To achieve the above objects, a passenger conveyor moving handrail is constituted by a core member and a rubber surface decorative member which is removably attached, i.e. removably engaged, to the core member, with the core member from which the rubber surface decorative member is separated being driven by a handrail driving device.

With the above construction, the rubber surface decorative member can be reused after being changed as desired since it is removably attached, i.e. removably engaged to the core member, and the rubber surface decorative member is prevented from being contaminated by the handrail driving device since only the core member is driven.

Further, in order to achieve the above objects, a core member and a rubber surface decorative member are formed separately and joined together.

The core member and the rubber surface decorative member are made to fit in with each other for assuring the joining, with the rubber surface decorative member being constituted by a horseshoe portion and joint portions for facilitating the forming, and the core member adopts a chain structure with L-shaped links and projection pins for decreasing the flexural rigidity. Moreover, the core member of this chain structure is free of oil contamination by employing pins of stainless steel, bushes of the oilless type, and links and rollers of synthetic resin.

According to the above technical measures, the rubber surface decorative member alone is formed into the horseshoe shape so that a continuous extrusion molding is possible. Further, the flexural rigidity of the core member is decreased due to the chain structure.

DETAILED DESCRIPTION OF PREFERRED EMBODIMENTS

Figure 1:
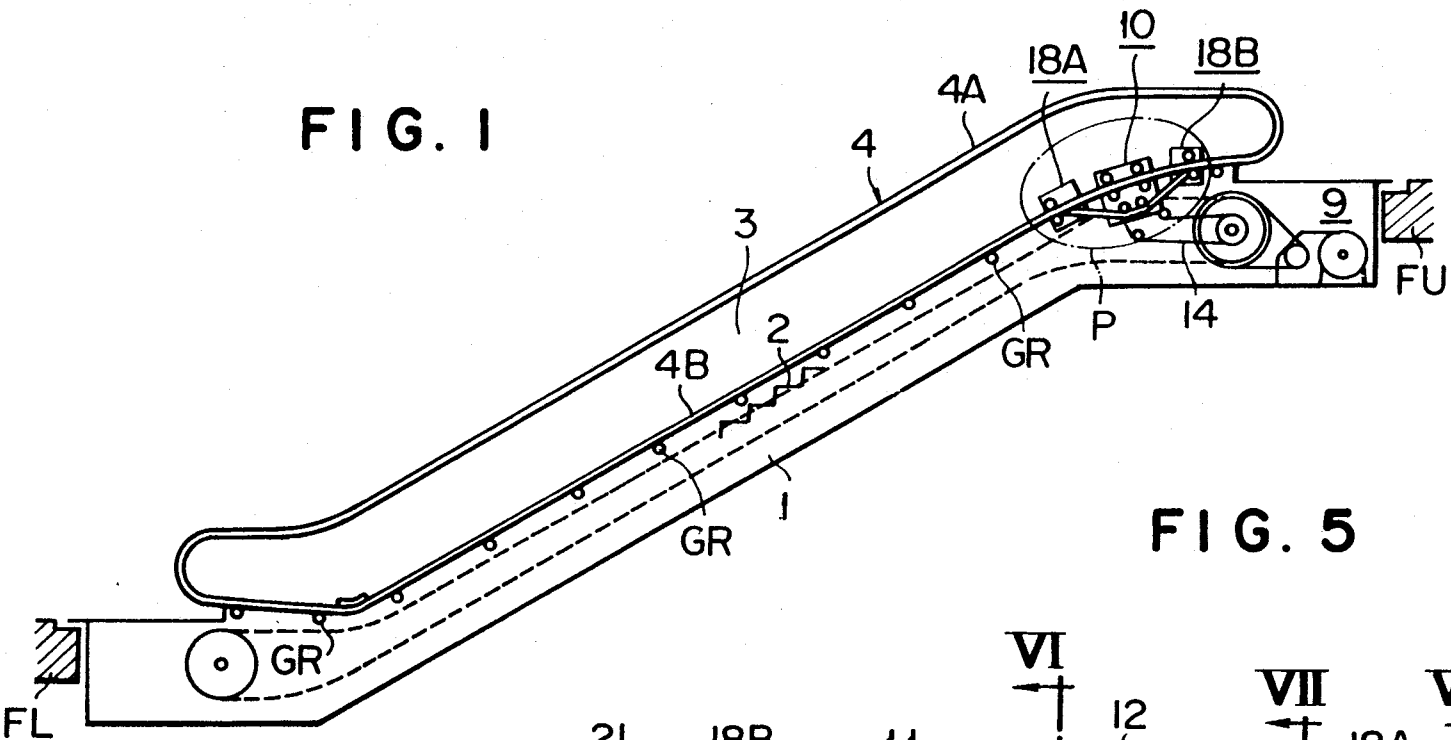
FIG. 1 is a schematic side view of an escalator according to the present invention.
Figure 5:
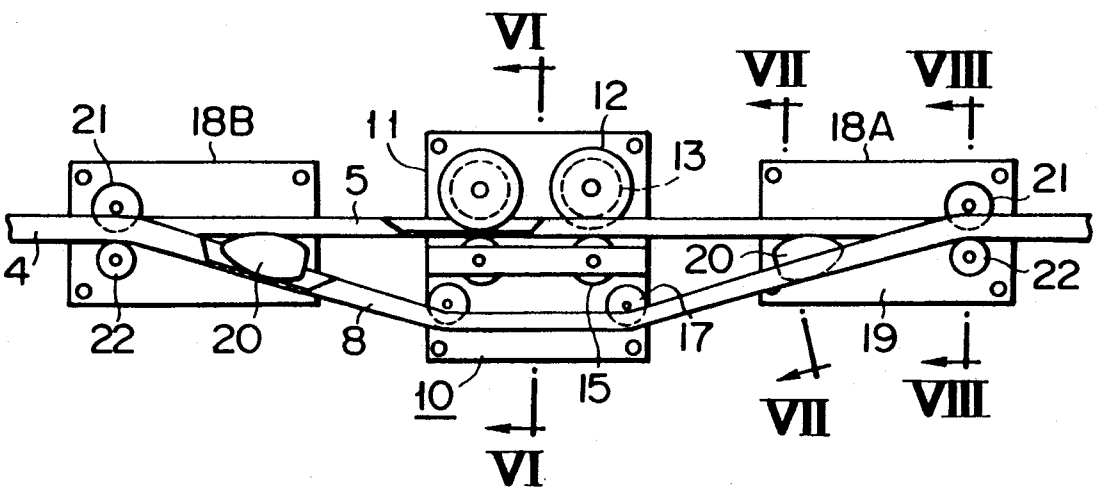
FIG. 5 is an enlarged view of a portion P shown in FIG. 1.
Figure 2:
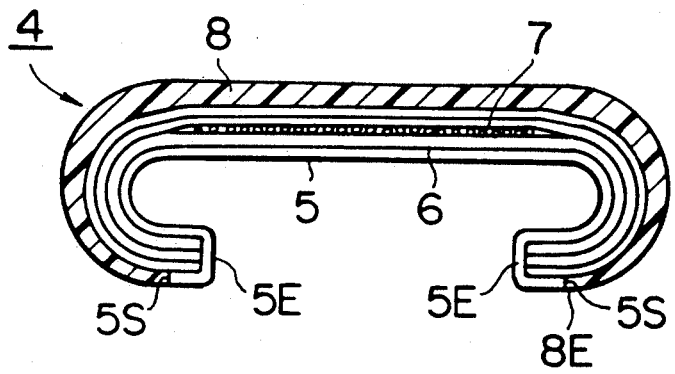
FIG. 2 is a vertical sectional front view of a moving handrail according to the present invention.

Referring now to the drawings wherein like reference numerals are used throughout the various views to designate like parts and, more particularly, to FIGS. 1–8, according to a first embodiment of the present invention, an escalator, that is, a passenger conveyor comprises a main frame 1 bridging a lower floor FL and an upper floor FU, an endless moving stairway 2, and a balustrade 3 vertically installed on each side of the stairway 2 along its moving direction. An endless moving handrail 4 is guided to move around the periphery of the balustrade 3 and driven by a handrail driving device 10 in its return run 4B. The handrail driving device 10 and the stairway 2 are driven by a driving device 9 provided in the main frame 1. The moving handrail 4 is supported by a plurality of guide rollers GR in its return run 4B so as to run through the regular positions.

The basic construction of the above escalator is the same as the conventional one. The present embodiment, however, is characterized by the structure of the moving handrail 4 and by the handrail driving device 10. More specifically, the moving handrail 4 includes a core member 5 serving as strength member and a surface decorative member 8 removably attached, i.e. removably engaged to the surface of the core member 5. The core member 5 is formed by a core material 7 which is flexible but less susceptible to elongation, such as metallic tape, metallic wire, aromatic polyamide fiber or the like, and sailcloth 6 put in layers upon each surface of the core material 7, with the core member 5 being shaped to have a C-shaped cross section and then subjected, as a whole, to vulcanization with chloroprene rubber, for example. The core member 5 is formed on its outside with stepped portions 5S (FIG. 4) at end portions 5E of the C-shaped section thereof so that, when the surface decorative member 8 is attached to the surface of the core member 5, end portions 8E of the surface decorative member 8 fill the stepped portions 5S so as to provide for a flush joining of the surface decorative member 8 with the core member 5, thereby preventing the passengers from feeling a sense of incongruity when taking hold of the handrail.

Figure 3:
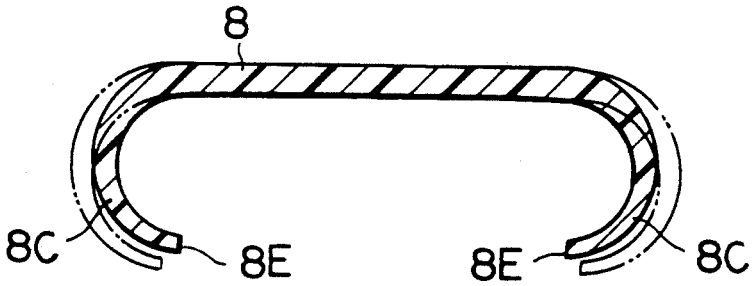
FIG. 3 is a vertical sectional front view of a surface decorative member shown in FIG. 2.
Figure 4:
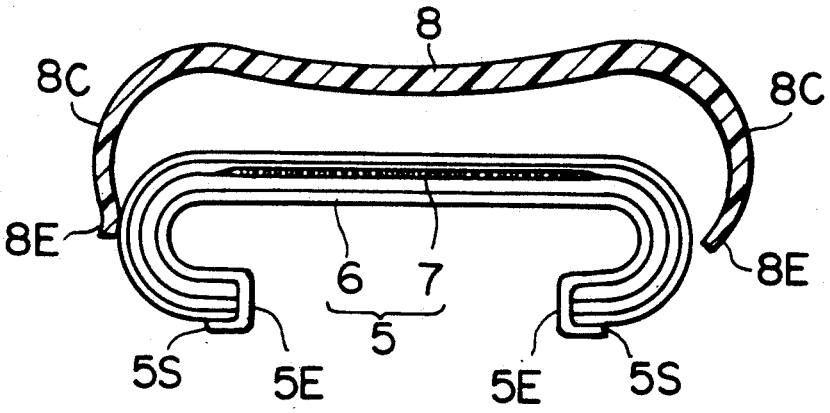
FIG. 4 is a vertical sectional view showing the manner of attaching and detaching the moving handrail shown in FIG. 2.
Figure 6:
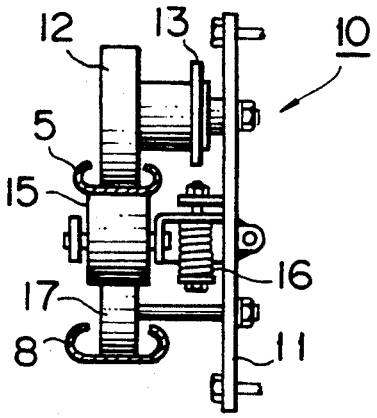
FIGS. 6 to 8 are sectional views taken along the lines VI—VI, VII—VII and VIII—VIII of FIG. 5, respectively.
Figure 7:
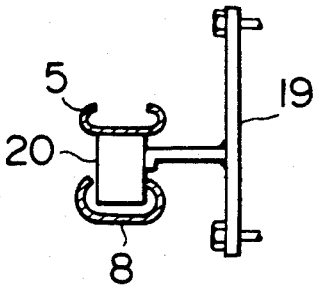
Figure 8:
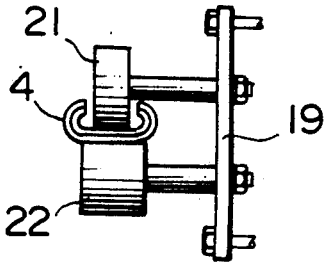

On the other hand, the surface decorative member 8 is continuously molded using an elastic material such as a thermoplastic resin, i.e. thermal plastic. In this case, the surface decorative member 8 can be arbitrarily colored differently from the core member 5 and, also, it can be multicolored or decorated with various patterns. Furthermore, it is possible to decorate the surface of the surface decorative member 8 with cloth. As shown in FIG. 3, such surface decorative member 8 is formed to be bent, when it is separated, at its curved portions 8C and end portions 8E inwardly of the shape (indicated by two-dot chain lines) into which it is to be changed when attached to the core member 5. In attaching, therefore, the opposite end portions 8E are stretched outward and, then, the surface decorative member 8 is attached to the core member 5 while bending the curved portions 8C rearwardly, as shown in FIG. 4. After the attaching, the surface decorative member 8 can be held on the core member 5 due to its restoring force (elastic force).

In case that the moving handrail 4 of the above construction is driven by being pinched by the handrail driving device including a plurality of rollers, the surface decorative member 8 is contaminated in the same conditions as those of the prior art. In this case, the surface decorative member 8 is exchanged for a new one each time it is contaminated, during which this contaminated surface decorative member 8 is cleaned and disinfected in preparation for the next exchange. It is therefore possible to repeatedly use the surface decorative member 8.

In the present embodiment, however, in order to lengthen the time period between exchanges, the surface decorative member 8 is not applied with the pinching force by the rollers but the core member 5 is driven by being pinched by the rollers. As shown in FIG. 1 and FIGS. 5 to 8, a separation device 18A for separating the moving handrail 4 of the above structure into the core member 5 and the surface decorative member 8 and an attaching device 18B for attaching the separated surface decorative member 8 to the surface of the core member 5, respectively provided upstream and downstream of the handrail driving device. The handrail driving device 10 comprises a support plate 11 fixed to the main frame 1 and having provided thereon driving rollers 12 for driving the core member 5 from which the surface decorative member 8 is separated and driven rollers 15. Each driving roller 12 is pivotally supported by the support plate 11 together with a sprocket 13, and each driven roller 15 is supported by the support plate 11 through a spring 16. The spring 16 serves to press the driven roller 15 against the driving roller 12 so as to apply the pinching force to the core member 5. The driving roller 12 may be pressed against the driven roller 15 using a spring or other means. A chain 14 (FIG. 1) is extended over the sprocket 13 for transmitting the power from the driving device 9. In addition, guide rollers 17 are pivotally supported by the support plate 11 for preventing the separated surface decorative member 8 from winding around the driven rollers 15.

The separation device 18A and the attaching device 18B are designed to have the same structure lest their functions be changed in accordance with the direction of operation (ascending and descending) of the escalator. The separation device 18A comprises a support plate 19 which is fixed to the main frame 1 and has a separator 20, separating the moving handrail 4 into the core member 5 and the surface decorative member 8, and oppositely disposed pivotally supported rollers 21 and 22 for holding the moving handrail 4. These support rollers 21 and 22 serve to attach the separated surface decorative member 8 onto the core member 5 in the attaching device 18B.

Since the escalator according to the present embodiment has the described construction, the surface of the moving handrail 4 is less contaminated. Namely, even if the surface of the moving handrail 4 is contaminated during the ascending movement in the forward course 4A, the surface decorative member 8 is separated from the core member 5 by the separator 20 in the return run 4B in advance of arrival at the handrail driving device 10, so that the core member 5 alone is driven in the handrail driving device 10 by being pinched by the driving rollers 12 and the driven rollers 15. Thereafter, the surface decorative member 8 is attached to the surface of the core member 5 by the support rollers 21 and 22 of the attaching device 18B. Accordingly, since there is no possibility that, even if the surface decorative member 8 is contaminated, it is applied on its surface with the pinching force which is strong enough to move the entire moving handrail, it is possible to easily remove the contamination from the surface decorative member 8 by a simple wiping of the contamination.

Further, since the moving handrail 4 is designed such that the surface decorative member 8 is removably attached to the core member 5, it is possible to change the color and pattern of the surface decorative member 8 in accordance with the interior decoration and architectural design of the building in which the escalator is to be installed, irrespective of the contamination.

It is noted that the core member 5 substantially united with the moving handrail of the escalator circulates along the same locus as the moving handrail but the surface decorative member 8 which is separated from the core member 5 for a distance equal to that between just downstream and upstream of the handrail driving device 10 moves along a different locus. For this reason, the length of the surface decorative member 8 is selected to be longer than the length of the core member 5 as well as to keep a distance from the driven rollers 15 of the handrail driving device 10 used for driving the core member 5 in order to avoid any interference. However, the core member 5 may be made longer than the surface decorative member 8 and curved in the region of the handrail driving device 10.

In the described embodiment, the escalator is operated to make an ascent. To the contrary, in case of operating the escalator to make descent, the separator 20 of the attaching device 18B serves to separate the surface decorative member 8 from the core member 5 and the support rollers 21 and 22 of the separation device 18A serve to attach the surface decorative member 8 onto the core member 5.

In addition, in the described embodiment, the surface decorative member 8 can be held on the core member 5 due to the elastic force of the surface decorative member 8. Alternatively, the surface decorative member 8 can be held on the core member 5 by making magnetic force.

Figure 9:
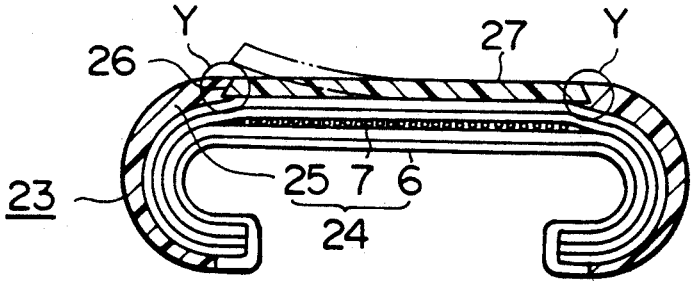
FIGS. 9 and 10 are vertical sectional front views of other embodiments of the moving handrail according to the present invention.

In the embodiment of FIG. 9, a moving handrail 23, as shown in FIG. 9, includes a core member 24 which is formed by the sailcloth 6, core material 7 and a surface decorative layer 25. The surface decorative layer 25 is formed therein with a trapezoidal channel 26 at the center of its surface. A flat decorative member 27 with the same cross section as the trapezoidal channel 26 is removably fitted in the trapezoidal channel 26 utilizing acute-angled portions Y thereof. In this case, the width of the flat decorative member 27 is selected to be larger than the width over which contacts the driven roller 15 of the handrail driving device 10 shown in FIG. 6. According to this kind of moving handrail 23, the simple cross section of the flat decorative member 27 makes it easy to manufacture.

Figure 10:
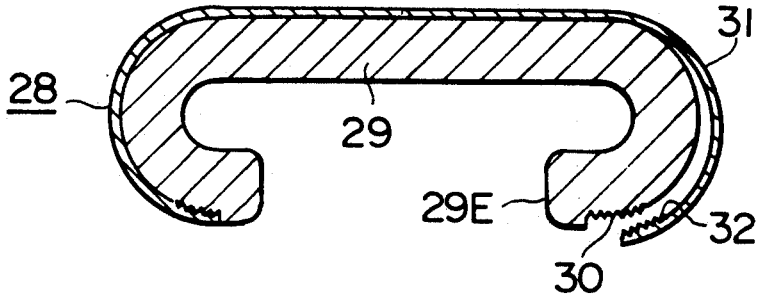

A moving handrail 28, as shown in FIG. 10 includes a core member 29 and a film-like surface decorative member 31. Fine notched portions 30 and 32 are respectively formed in the outside surface of the core member 29 at opposite end portions 29E thereof and in the inside surface of the surface decorative member 31 at opposite end portions thereof. The surface decorative member 31 can be held on and separated from the core member 29 by bringing these notched portions 30 and 32 into and out of engagement, thus facilitating the attaching and detaching. These notched portions 30 and 32 may be replaced by a number of fine fibrous loops and a number of fine fibrous hooks, with the loops and hooks being brought into and out of engagement in use.

Figure 11:
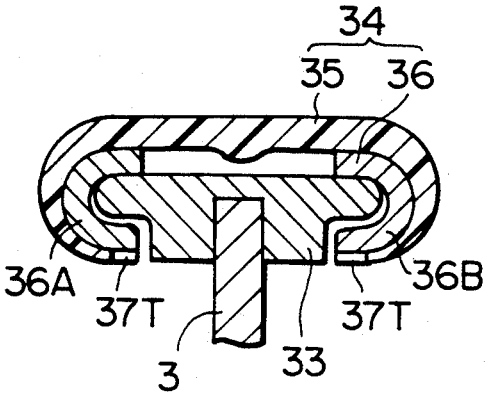
FIG. 11 is a vertical sectional front view of a further embodiment of the moving handrail according to the present invention.
Figure 12:
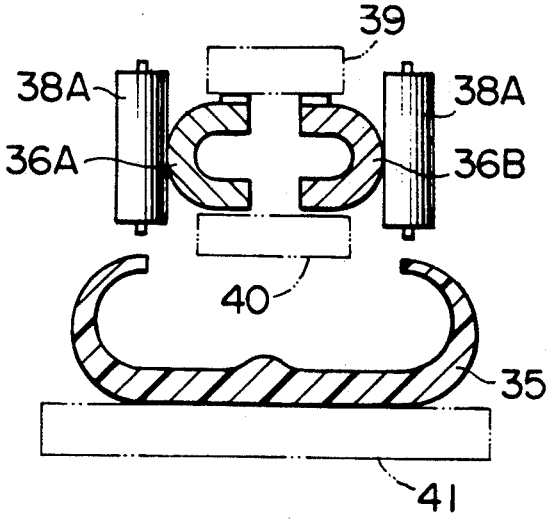
FIGS. 12 and 13 are schematic front views showing the moving handrail shown in FIG. 11 when separated or attached and when driven, respectively.
Figure 13:
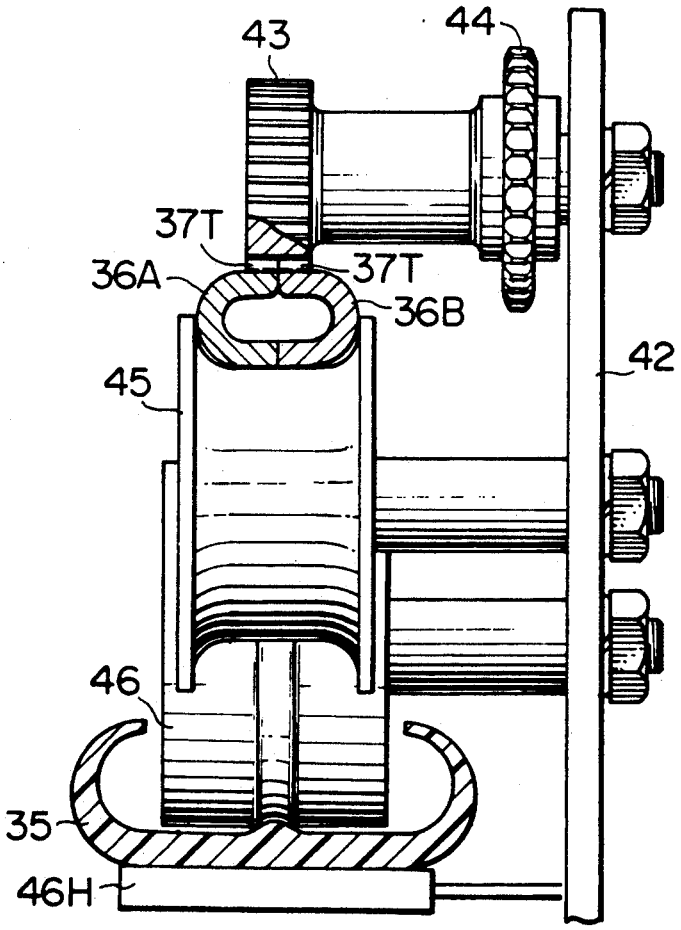

In the embodiment of FIGS. 11–13, a moving handrail 34 includes a surface decorative member 35 and a core member 36, with the surface decorative member 35 being removably attached to the core member 36 in a manner described embodiments. However, the core member 36 is designed to be symmetrically divided into right and left core halves so that, when running along a guide rail 33 on the balustrade 3, they are located inwardly of the curved portions of the surface decorative member 35 and, when passing through the separation device or the attaching device provided downstream or upstream the handrail driving device, they are removed from the guide rail 33 and pressed by right and left pressure rollers 38A and 38B, which are arranged to reduce the gap therebetween, so as to reduce the gap between them as shown in FIG. 12. In this state, the surface decorative member 35 is separated under guidance of a separating roller 40. The core member 36, thus separated from the surface decorative member 35, is received by a guide roller 45 without leaving any gap between the right and left core halves in the handrail driving device shown in FIG. 13. These right and left core halves 36A and 36B are provided with racks 37T at positions on their respective outside surfaces which correspond to open ends of the C-shaped cross section. A driving pinion 43 engages with these racks 37T so as to drive the core halves 36A and 36B. The driving pinion 43 is united with a driving sprocket 44 and pivotally supported by the support plate 42. The power of the driving sprocket 44 is transmitted in the same manner as described hereinabove. The separated surface decorative member 35 is prevented from interference with the guide roller 45 by guide rollers 46 and 46H separately pivotally supported by the support plate 42. The core member 36 (constituted by the core halves 36A and 36B) passed through the handrail driving device and the surface decorative member 35 are attached to each other, in the attaching device, by the device shown in FIG. 12. More specifically, an attaching roller 41 arranged to approach the core member 36 causes the surface decorative member 35 to shift its moved locus toward the core member 36 (36A, 36B). The moved locus of the surface decorative member 35 is shifted until it coincides with the moved locus of the core member 36. As the both moved loci coincide with each other, the core halves 36A and 36B, near to each other, are separated right and left by a guide means (not shown) with the distance therebetween made larger until they finally reach the position at which the guide means (not shown) has a cross section similar to that of the guide rail 33 shown in FIG. 11. In this state, the core halves 36A and 36B are positioned inside of the right and left curved portions of the surface decorative member 35.

In the embodiment of FIGS. 11-13, since the surface decorative member 35 is applied with no strong pinching force, it is possible to remove the contamination from the surface decorative member 35 by a simple wiping even if contaminated. Further, since it is also possible to replace the surface decorative member 35 at will, the same effects are achieved as in the above-described embodiments.

In each of the above-described embodiments, when the surface decorative member 8, 27, 31 or 35 is removed with the intension of simply disposing of the member, the member 8, 27, 31 or 35 is cut off at a portion thereof in the forward course 4A of the moving handrail 4 shown in FIG. 1 and the escalator is operated with one of the cut ends held by the operator. As a result, it is possible to successively draw off and finally remove the surface decorative member 8, 27, 31 or 35.

On the other hand, to remove the surface decorative member 8 (27, 31, 35) which is intended to be reused reference is once again made to FIGS. 1 to 5. In the return path run 4B, a skirt guard (not shown) which is provided between the moving handrail 4 and the stairway 2 below the balustrade 3 of the escalator and an inner deck cover (not shown) above the skirt guard are removed, the distance between the support rollers 21 and 22 of the separation device 18A and the attaching device 18B (FIG. 5) is made longer to allow the surface decorative member 8 to be separated from the core member 5, and the surface decorative member 8 thus separated is drawn sidewards toward the stairway 2. Then, in the forward run 4A of the moving handrail 4, the surface decorative member 8 is removed from the core member 5.

In addition, when a new or different surface decorative member 8 is attached to the core member 5, the surface decorative member 8 is arranged substantially along the core member 5 in the first place, it is then pressed onto the core member 5 in order by the operator except for a portion thereof corresponding to the region including the handrail driving device 10, the separation device 18A and the attaching device 18B, and, finally, the surface decorative member 8 is set in the devices 10, 18A and 18B in such a manner that the driven rollers 15, the guide rollers 17 and the separators 20 of these devices are positioned between the core member 5 and the surface decorative member 8, and the distance between the support rollers 21 and 22 is reset to the predetermined size, thereby completing the attaching. Alternatively, after arranging the surface decorative member 8 along the entire circumference of the core member 5, the core member 5 and the surface decorative member 8 are mounted in normal position on the handrail driving device 10 and the attaching device 18B and, in this state, the escalator is then operated at a low speed. As a result, the surface decorative member 8 is attached to the core member 5 in order without requiring any labor except that the separation device 18A is set in normal state after one round is over.

As described above, in case of attaching the surface decorative member 8 to the core member 5 in the place where the escalator is installed, the escalator is operated with the separation device 18A suspended, while, in case of separation, the escalator is operated with the attaching device 18B suspended. It is therefore possible to easily perform the attaching and detaching operations.

In addition, it is necessary, in case of forming the endless surface decorative member 8, 27, 31 or 35, to make a joint as small as possible so as not to attract attention. In consideration of the bending in various directions effected on the surface decorative member, however, it is desirable that the joint is oblique with respect to the forward direction of the handrail and that end surfaces thereof are joined to each other by bonding with use of adhesives or by welding.

In the above-described embodiments, the escalator has been referred to as the passenger conveyor, and however, it goes without saying that the present invention is applicable to the motor driven passenger walkway with no stairway.

According to the present invention, since the core member of the moving handrail is driven by the handrail driving device, the surface of the moving handrail is prevented from being pressed and stuck thereon with the contamination by the handrail driving device. It is therefore possible to obtain the passenger conveyor which is not susceptible to be contaminated. Further, since it is possible to separate the surface decorative member from the core member, the contamination can be removed by exchanging the surface decorative member alone, thus contributing to economization. In addition, since it is possible to attach and detach a surface decorative member of desired color and pattern regardless of the contamination, the present invention is effective from the viewpoint of design as well.

Figure 14:
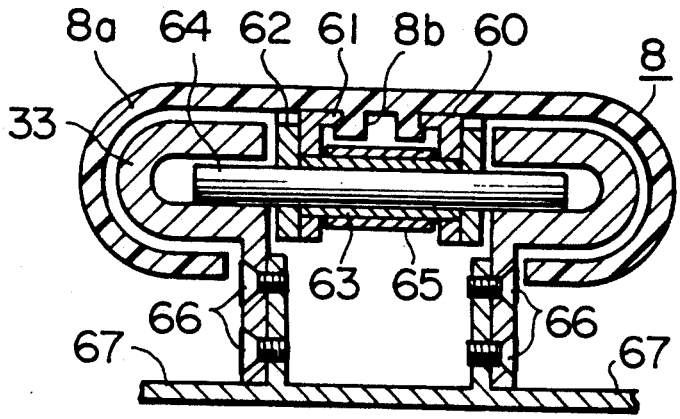
FIG. 14 is a sectional view of a moving handrail of a passenger conveyor according to still another embodiment of the present invention.
Figure 15:
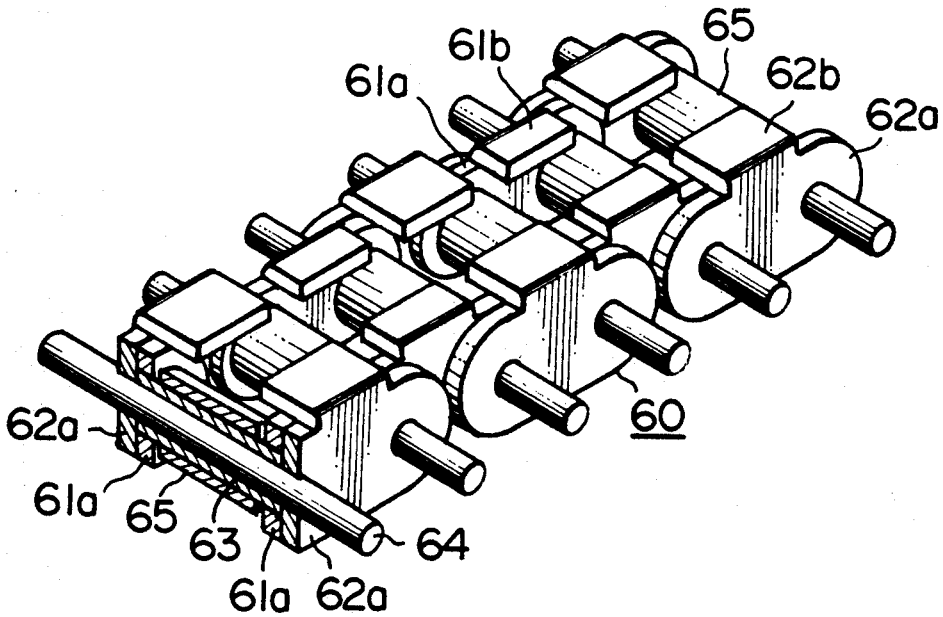
FIG. 15 is a perspective view of only the core member shown in FIG. 14 from which the rubber surface decorative member is removed.

In the embodiment of FIGS. 14 and 15 a rubber surface decorative member 8 includes a horseshoe portion **8*a* to which the person directly holds on and joint portions 8*b* for joining with a core member. A core member 60, fashioned as a chain structure as shown in FIG. 15, is formed by inner links 61, outer links 62, bushes 63, pins 64 and rollers 65. Each of the inner links 61 includes a linking portion 61*a* and a joint (engaging) portion 61*b* for joining with the rubber surface decorative member 8. Similarly, each of the outer links 62 includes a linking portion 62*a* and a joint (engaging) portion 62*b* for joining with the rubber surface decorative member 8. Each of the pins 64 projects outwardly of the outer links 62**.

Guide rail unit 33 is fixed to a balustrade frame 67 with countersunk screws 66 in such a manner so as to guide the core member 60 in the vertical direction while being engaged with the projecting portions of the pins 64 and in the horizontal direction along right and left guide rails thereof.

The joint portions **8*b* of the rubber surface decorative member 8 and the joint portions 61*b* and 62*b* of the core member 60 are made to fit in with each other due to their substantially square configuration, the joint portions 8*b* of the rubber surface decorative member 8** being made to fit in elastically since they are made of a rubber elastic material. This arrangement contributes to the prevention of movement in both horizontal and vertical directions.

Moreover, the pin 64 is made of stainless steel, the bush 63 is of the oilless type, and the inner link 61, the outer link 62 and the roller 65 are made of synthetic resin, thus providing a rust proof structure.

Further, it is preferred to select as the material for the guide rail unit 33 a low-friction and sound-absorbing material, and the synthetic resin is most suitable.

Figure 16:
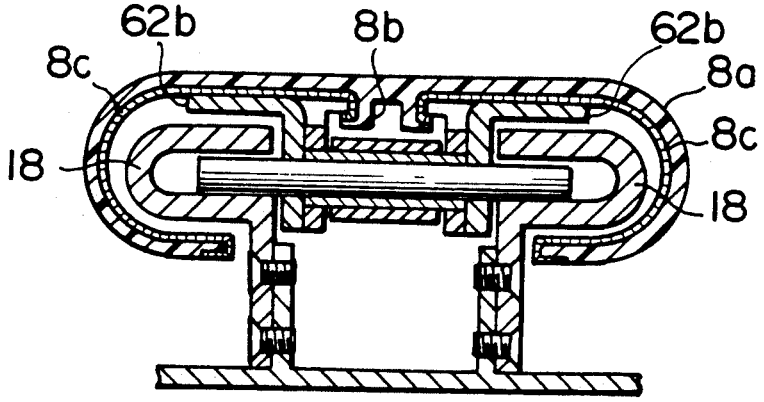
FIG. 16 is a sectional view of a further embodiment of the present invention.
Figure 17:
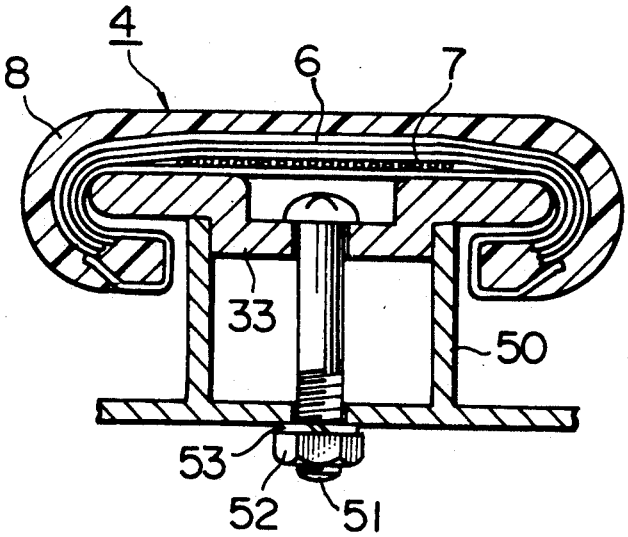
FIG. 17 PRIOR ART
FIG. 17 is a sectional view of a moving handrail of a passenger conveyor according to the prior art.

As shown in FIG. 16, it is possible to support the horseshoe portion **8*a* of the rubber surface decorative member 8 over a wider width by forming the joint portion 62*b* of the outer link 62** so as to extend outwardly.

In addition, it is possible to obtain a stable horseshoe shape by putting sailcloth 8c on the inside of the horseshoe portion 8a of the rubber surface decorative member 8.

According to the present invention, since the rubber surface decorative member is formed by the decorative rubber alone or by the combination of decorative rubber and sailcloth, it can be formed by the continuous vulcanizing extrusion molding. It is therefore possible to reduce the time required for the molding as compared with the prior art.

Further, since the core member adopts a chain structure, it is possible to decrease the flexural rigidity in the longitudinal direction as compared with the prior art.

What is claimed is:

1. A passenger conveyor comprising:

an endless moving handrail mounted on a guide member provided around a balustrade, said moving handrail including a core member formed in an endless manner and a surface decorative member removably engaged with said core member and covering a surface of said core member over the whole length thereof; and a handrail driving means for driving said core member of said moving handrail to move along a circulating path, wherein said core member includes projecting portions guided in a guide groove of said guide member and engaging and holding portions for engaging with and holding said surface decorative member, said guide member includes at least a lateral portion covered by said surface decorative member.

2. A passenger conveyor according to claim 1, wherein said core member and said surface decorative member have different lengths so as to form a gap therebetween.

3. A passenger conveyor according to claim 2, wherein the length of said core member is shorter than the length of said surface decorative member.

4. A passenger conveyor according to claim 1 wherein said handrail driving means is provided in a return run of said circulating path.

5. A moving handrail for a passenger conveyor comprising a core member formed in an endless manner and a surface decorative member having an inner surface which covers said core member, wherein said core member includes projecting portions guided in a guide groove of a guide member provided around a balustrade, said guide member includes at least a lateral portion covered by said surface decorative member, said surface decorative member is removably engaged with said core member and provided so as to cover a surface of said core member over the whole length thereof, and said core member is provided with engaging and holding portions for engaging with and holding said surface decorative member.

6. A moving handrail for a passenger conveyor according to claim 5, wherein said surface decorative member has a color different from a color of said core member.

7. A moving handrail for a passenger conveyor according to claim 5, wherein said surface decorative member is provided with a decorative pattern.

8. A moving handrail for a passenger conveyor according to claim 5, wherein said surface decorative member is made of a thermoplastic material.

9. A moving handrail for a passenger conveyor according to claim 5, wherein said surface decorative member is made of a thermoplastic flexible material.

10. A moving handrail for a passenger conveyor comprising a core member formed in an endless manner and a surface decorative member having an inner surface which covers said core member, wherein said core member is provided with engaging and holding portions for removably engaging with and holding said surface decorative member, engaging portions engageable with a handrail driving means, and projecting portions guided in a guide groove of a guide member provided around a balustrade, said guide member includes at least a lateral portion covered by said surface decorative member, and wherein said surface decorative member is provided so as to cover a surface of said core member over the whole length thereof.

11. A moving handrail for a passenger conveyor comprising a tension bearing core member formed in an endless manner and a rubber surface decorative member adapted to be directly held by a hand of passenger, wherein said core member and said rubber surface decorative member are formed separately and jointed together, and wherein said core member is provided with projecting portions guided in a guide groove of a guide member provided around a balustrade and portions for removably engaging said rubber surface decorative member to a central portion in a traverse direction thereof, said guide member includes at least a lateral portion covered by said surface decorative member, and wherein said surface decorative member is formed so as to cover as surface of said core member over the whole length thereof.

12. A moving handrail of a passenger conveyor according to claim 11, wherein the rubber surface decorative member includes a horseshoe-shaped portion and joint portions.

13. A moving handrail of a passenger conveyor according to claim 11, wherein said core member includes a chain formed of L-shaped links having one side facing a rear surface of said rubber surface decorative member and projection pins engaged with a guide member provided around said balustrade.

14. A moving handrail for a passenger conveyor comprising a tension bearing core member formed in an endless manner and a rubber surface decorative member adapted to be directly held by a hand of passenger, wherein said core member and said rubber surface decorative member are formed separately and jointed together, said core member includes a chain formed of links and projection pins, said pins are formed of stainless steel, said chain further includes oilless bushes and rollers, and said links and said rollers are formed of a synthetic resin.

15. A moving handrail of a passenger conveyor according to claim 14, wherein the links of said chain formed of links are L-shaped links.

* * * * *